United States Patent [19]

Yoneji et al.

[11] 4,182,252

[45] Jan. 8, 1980

[54] CONTROL SYSTEM FOR A SEWING MACHINE

[75] Inventors: Satoshige Yoneji; Yoshiharu Higuchi; Shushin Mori, all of Nagoya, Japan

[73] Assignee: Brother Kogyo Kabushiki Kaisha, Nagoya, Japan

[21] Appl. No.: 879,107

[22] Filed: Feb. 17, 1978

[30] Foreign Application Priority Data

Feb. 18, 1977 [JP] Japan ..... 52/17433

[51] Int. Cl.[2] ..... D05B 69/18; D05B 69/20

[52] U.S. Cl. ..... 112/317

[58] Field of Search ..... 112/210, 121.11, 277, 112/300, 203, 316, 317

[56] References Cited

U.S. PATENT DOCUMENTS

| | | | |
|---|---|---|---|
| 3,750,603 | 8/1973 | Martin | 112/300 |
| 4,080,914 | 3/1978 | Ishida et al. | 112/277 |

*Primary Examiner*—Peter Nerbun

*Attorney, Agent, or Firm*—Browdy and Neimark

[57] ABSTRACT

A control system for a sewing machine includes at least an impulse generating circuit and a counter means connected thereto. A shift register having at least four bits and a mode selecting circuit connected thereto is provided. A circuit for feeding the work material or fabric forwards, a circuit for feeding the work material backwards, and a circuit for resetting these circuits are provided. The system is:

(1) capable of selecting, in advance, the number of stitches in a single forward and backward reciprocal non-ravel seaming;

(2) capable of doing a desired number of the repeated non-ravel seaming on a certain place (repeated reciprocal non-ravel seaming mode); and (3) capable of free selecting between the conventional non-ravel seaming mode and the above-mentioned repeated non-ravel seaming mode (the free mode selection). The selection is between the mode wherein a single starting non-ravel seaming and a single finishing non-ravel seaming are executed on the opposite ends of an ordinary straight seaming in the middle and the other mode wherein the above-mentioned repeated non-ravel seaming is executed at a desired number of repetition.

12 Claims, 8 Drawing Figures

FIG. 1
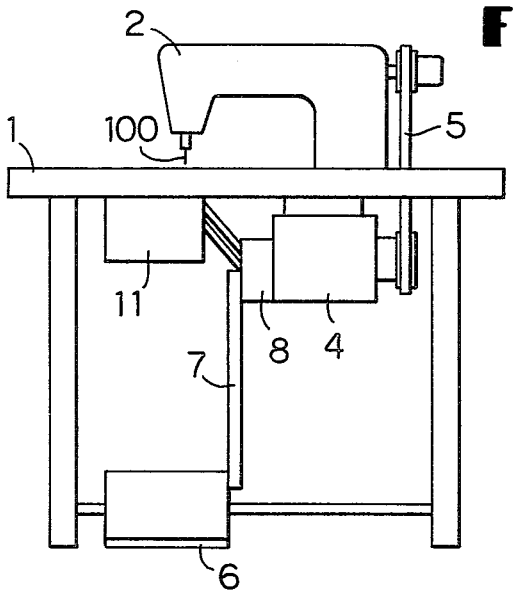
FIG. 4
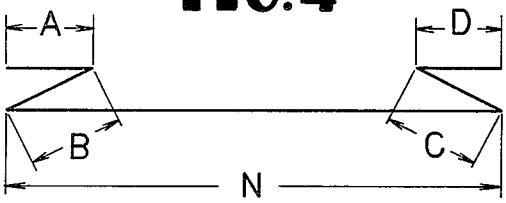
FIG. 5
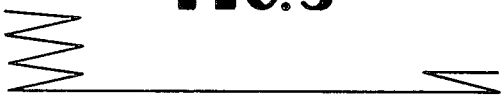
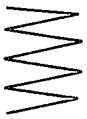
FIG. 6

SOLENOID
3
31
FLIP-FLOP
32
34
FLIP-FLOP
33
35
SHIFT REGISTER
18
38
40
43
44
39
45
41
18A
18B
18N
18C
18D
14
14b
15
15b
16
16b
17
17b
SET SIGNAL GENERATOR
RE-NON-RAVEL SEAMING SIGNAL GENERATOR
37
47
36
48
STOPPING SIGNAL GENERATOR
12
PULSE GENERATOR
13
DIGITAL COUNTER
46
TOE SIDE DEPRESS SIGNAL GENERATOR
HEEL SIDE DEPRESS SIGNAL GENERATOR
9
10
42
SIGNAL GENERATOR

CONTROL SYSTEM FOR A SEWING MACHINE

BACKGROUND OF THE INVENTION

This invention relates to a controlling system for a sewing machine, more particularly, to that having a work feeding means and a feed reversing means. This invention is especially useful for a non-ravel seaming in the beginning and finishing stage of sewing operation, and concerned particularly with the control of the non-ravel seaming device.

Heretofore many types of sewing machines have been provided, being capable of performing a non-ravel seaming at the beginning and/or finishing stage of the sewing operation. In a typical machine of those a non-ravel seaming process is as follows: (1) a seaming of forward feeding is carried out first for a certain period of time followed by that of opposite direction for another certain period of time; then (2) an ordinary seaming process of desired length is proceeded; and afterwards (3) a seaming of backward feeding for a certain period of time and again that in the opposite direction for another certain period of time are carried out as a finish step. These starting and finishing non-ravel seamings are to be done, of course, at the opposite ends of the ordinary seaming part in the middle in order to prevent the seaming from being raveled or unseamed.

The above-mentioned non-ravel seaming is, however, executed in a style wherein the forward and backward or reverse stitches are made overlappingly on the ordinary sewed stitches at the opposite end portions thereof.

This way of stitching is not enough durable under a rough use condition; non-ravel stitches applied on a thick cloth, material, or a dress are apt to be raveled or worn when the material is handled in a harsh way.

SUMMARY OF THE PRESENT INVENTION

It is a primary object of this invention to provide a sewing machine a control system which enables non-ravel seaming to be done as many times as desired in accordance with the requirement of the circumstance, which prevents the raveling or unseaming of the non-ravel seaming, and enlarges the utility of the sewing machine by concurrently enabling the non-ravel seaming to substitute for the bar tacking operation.

It is another object of this invention to provide a multi-object aiming control system which is capable of doing various types of non-ravel seaming by means of attaching a first and second readout switch for detecting the forward and reverse stitch number on the digital counter means in order to enabling a free selection of forward and reverse sewing stitch number as desired, which enlarges the utility of the machine even to, for example, a stretch stitching (two stitch forward and one stitch reverse) which is often done in domestic sewing operation with a cloth of elasticity such as jersey.

It is still another object of this invention to provide a control system which enables a simple switching between the ordinary non-ravel seaming and the repeated type non-ravel seaming.

It is further object of this invention to provide a control system, in addition to the above-mentioned mode selection, which enables all of the repeated and ordinary non-ravel seaming being variable in the number of stitches carried out by means of attaching four (from first to fourth) stitch number readout switches.

It is still further object of this invention to provide a control system which employs a digital counter and a shift register as well for rendering the system highly reliable and low in production cost. The shift register make it possible to monitor the normal operation of the system by means of an indicating means incorporating a light emitting diode.

BRIEF DESCRIPTION OF THE DRAWINGS

FIG. 1 is an elevation of a sewing machine;

FIG. 4 is an explanatory diagram useful in understanding non-ravel seaming;

FIG. 5 is a similar diagram to FIG. 4 illustrating a repeated type non-ravel seaming made at the initial stage of sewing;

FIG. 6 is an explanatory diagram of a repeated (back and forth) type non-ravel seaming;

DETAILED DESCRIPTION OF A PREFERRED EMBODIMENT CONSTRUCTION

Figure 2:
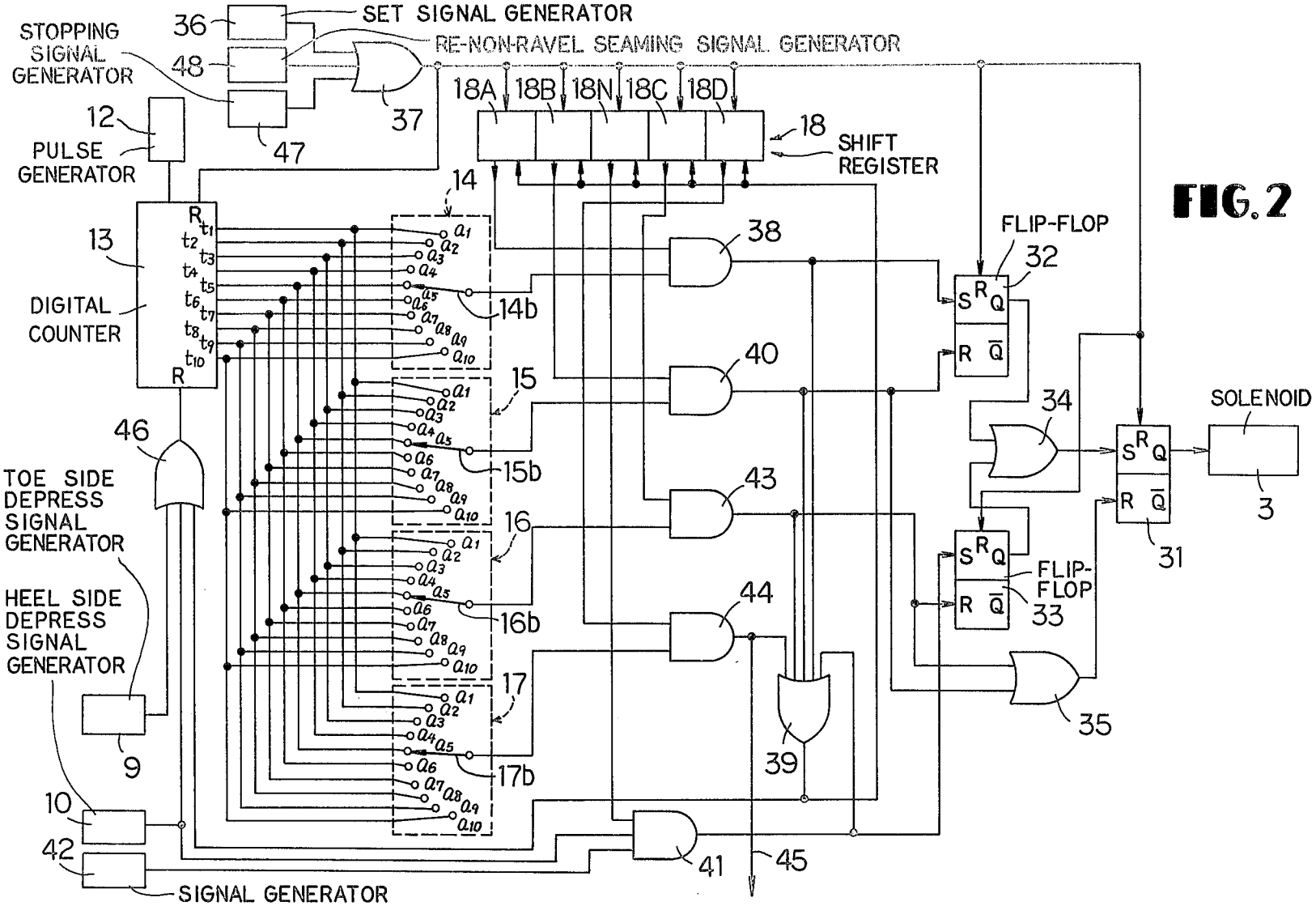
FIG. 2 is a circuit diagram of a non-ravel seaming circuit arrangement.

In FIG. 1, on a machine table 1 is mounted a sewing machine 2 (or a machine head), which is provided with a material feeding means capable of forward (positive) and backward (reverse) feeding and which is usually biased in a direction of forward feeding by means of a spring or the like. A needle 100 is attached to the under side, at the left end, of the machine 2 and is vertically reciprocable.

The feed-direction-reversing operation of the material feeding means is carried out by a reversible solenoid 3 (feed direction reversible solenoid) functioning as a direction reversing means for the material feeding.

The solenoid 3 should be mounted at an appropriate position on the frame of the machine 2; an air cylinder can be substituted for the solenoid.

The machine 2 is driven by a DC motor 4, a driving means, the output shaft of which is, via a belt 5, connected to the main shaft of the machine 2. The motor 4 is controlled by a foot pedal or treadle 6, which is depressable for the controlling purpose in two directions, i.e., in the toe direction and the heel direction of the operator. The pedal 6 is, via a rod 7, connected to an input switch means 8, which is to effect the production of a toe depressing signal from the toe depress signal generator 9 upon toe depressing action on the pedal 6 by the operator and a heel depress signal, which is produced by a heel depress signal 10, upon a heel depressing action on the pedal 6 effected by the operator. As the pedal 6 is depressed in the toe direction a speed controlling signal is generated for the DC motor 4. A controlling means 11 is provided beneath the table 1. The controlling means includes a controlling circuit, which interconnects an input switch means 8, the DC motor 4, a needle position sensor, a thread cutter, etc., and functions as a speed controller for the DC motor 4, as a needle positioner, as a thread cutter and as a means having the undermentioned non-ravel seaming capability at the same time. Additionally, when the machine 2 is operated for the non-ravel seaming, the DC motor 4 is set to rotate the machine 2 at a medium speed of approximately 1,500 r.p.m.

Figure 8:
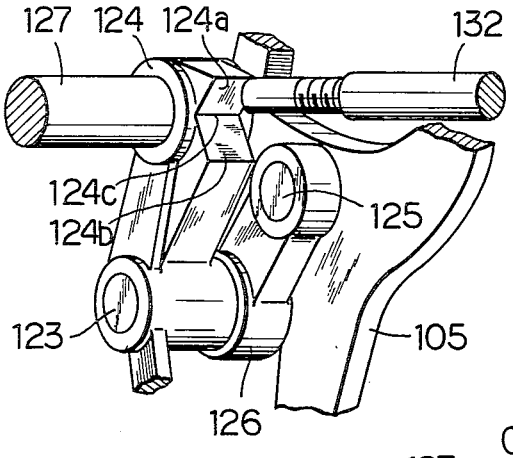
FIG.8 PRIOR ART
FIG. 8 is an enlargement of an essential portion of FIG. 7 (prior art).
Figure 7:
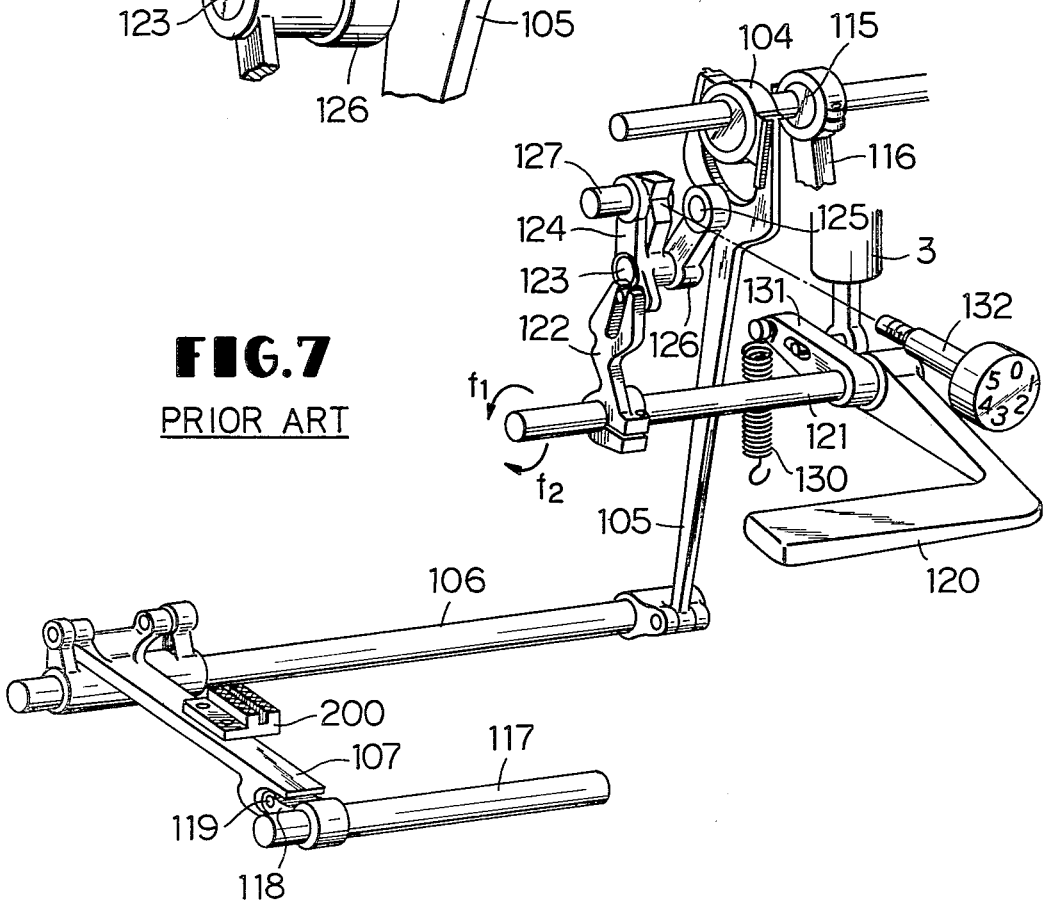
FIG.7 PRIOR ART
FIG. 7 is a perspective view of an important portion of a prior art material feeding mechanism.

In this embodiment a feed reversing means of a typical construction is illustrated in FIGS. 7 and 8 (both as prior art). A feed dog 200 is controlled in the feed direction by an oscillating rotation of a rod 106 controlled by a cam 104 fixed on the main shaft via a link 105 and in the up-and-down direction by oscillating rotation of a rod 117 controlled by a cam 115 fixed on the main shaft via a link 116.

The feed in the backward direction can be carried out by pushing a lever 120 to rotate a rod 121 (which is usually biased in the forward direction $f_1$ by a spring 130 via a lever 131), clockwise $f_2$ or anti-clockwise $f_1$ (looking from left to right in FIG. 7).

In an oval opening of the lever 131, a pin connected with said solenoid 3 is slidably engaged for reversing the feed direction.

The amount of the feed, forward and backward, can be controlled by a manually feed-regulating member 132, which is threadedly supported by the machine frame. The tip of the feed regulating member 132 can be contacted with any one of a pair of planes which intersect with each other at a predetermined angle along an intersection line 124*c*. A well-known feed regulator 124 is, on one hand, rotatably mounted on a stationary shaft 127 fixed to the machine frame and connected, on the other hand, oscillatably with a link 122 and pivotably with another link 126 via a pin 123.

The operation direction of the lever 120, upward or downward will determine the selection of the contact plane surface 124*a* or 124 *b* to be contacted with the tip of the feed regulating member 132, which will effect the direction of the feed dog movement, forward or backward, and the axial position of the tip of the feed regulating member 132 will determine the distance of the contact point from the intersection line of the plane 124*c* on each inclined plane surface 124*a* or 124*b*, which will effect the upward or downward movement of the feed dog 200.

With reference to the rest of the drawings, the explanation of the machine structure continues. Numeral 12 designates a pulse generator which generates or produces synchronously, with the driving of the machine or vertical movement of the machine needle stitch number, pulses of varying frequency, the frequency being in proportion to the machine running speed, i.e., it generates one pulse for every one rotation of the main shaft of the machine, which means a single stitch. The pulse generated from the pulse generator 12 are counted by a digital counter 13 of decimal system, which is provided with output terminals $t_1$ to $t_{10}$ for digitally indicating the successively changing status of the counter 13. There are four readout switches 14–17, from the first to the fourth, respectively connected to the output terminals of the digital counter 13. Each of these four readout switches 14–17, having respectively ten stationary contacts, from $a_1$ to $a_{10}$, is arranged on a circular arc to be contacted to any one of ten output terminals, from $t_1$ to $t_{10}$, and a rotary switch lever, from 14*b* to 17*b*, cooperating with the ten stationary contacts, is capable of reading out any desired status selected out of a plurality of terminals in the digital counter 13.

Out of the four readout switches, the first one 14 is for determining the A period of the non-ravel seaming, in FIG. 4, the second one for the B period, the third one for the C period, and the fourth one is for the D period.

There is provided a 5 bit shaft register 18 composed of five D type flip-flops 18A, 18B, 18N, 18C, and 18D, for specifying the order of the output signals from the first to fourth readout switches, 14–17 to each of whose Q output terminal is respectively connected a respective inverter 19, a respective resistor 20, and a respective light emitting diode (LED) 21, an indicating means. The anode of each LED 21 is connected to a fairly high level of power source (12 volts). When therefore the Q output of the D type flip-flops 18A–18D is at a high level (hereafter high level is indicated with "1" and low level with "0"), the light emitting diodes 31 emit light to indicate at which stage of the shift register 18 the output "1" is generated. Therefore, those (LED) diodes 21 are disposed at places easy to perceive for the operator.

Figure 3:
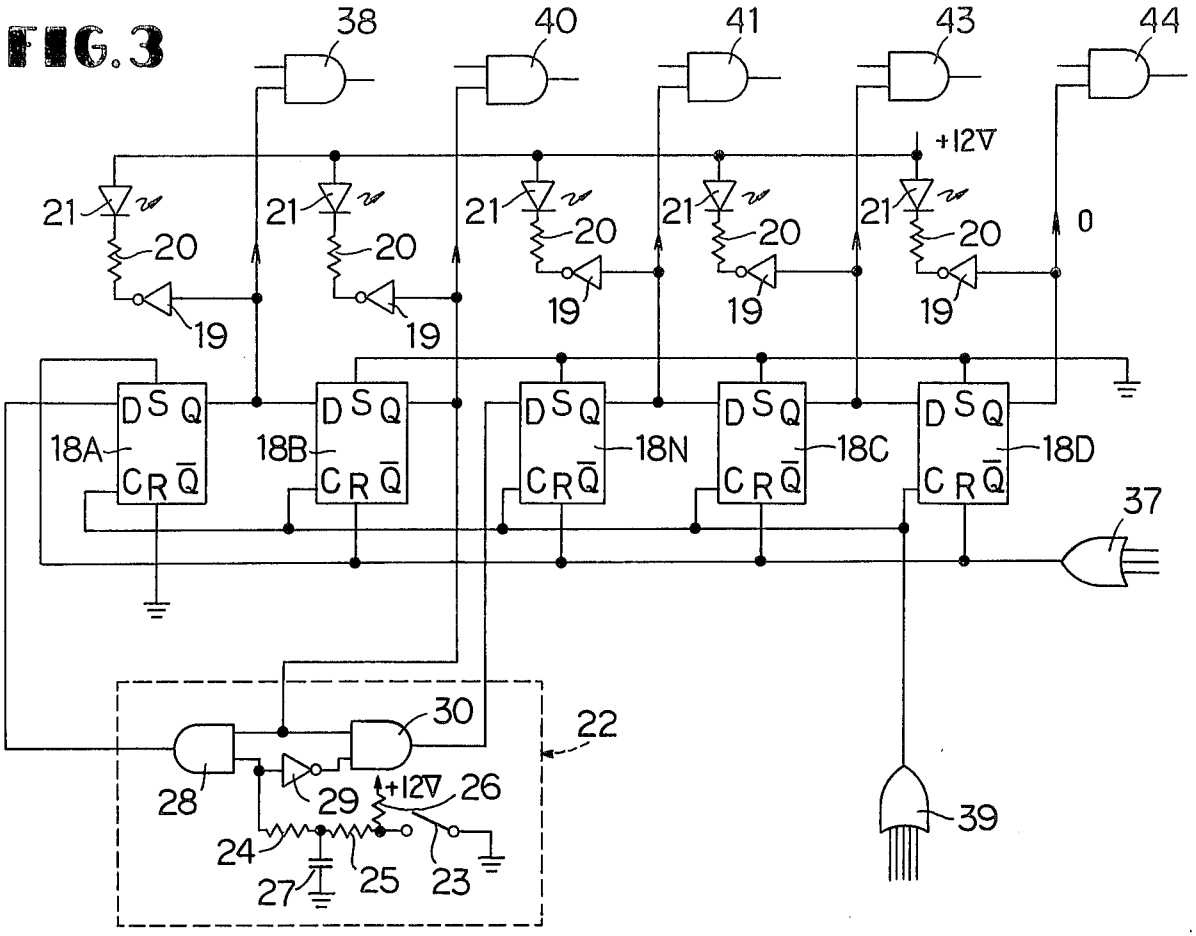
FIG. 3 is a detailed diagram of a portion of the circuit of FIG. 2.

Numeral 22 in FIG. 3 designates a mode selecting circuit connected to the shift register 18, capable of selectively switching the operation mode of the shift register 18 in two ways, a first and second mode, and in the former the output of the shift register 18 shifts in the order from the first stage 18A to the fifth stage 18D, and in the latter the output is shifted alternatively, i.e., circulated between the first stage 18A and the second stage 18B.

A mode selecting switch 23 is grounded at one end thereof and connected at the other end thereof to one end of a pair of resistors 24, 25 connected in series. Another resistor 26 is connected at one end thereof to a common contact of the mode selecting switch 23 and the resistor 25, and at the other end to a power source of 12 volts. A capacitor 27 is connected at one end thereof to a common contact of the pair of resistors 24, 25 and grounded at the other end thereof. The opposite side terminal from the capacitor 27 from the resistor 24 is connected to one input terminal of an AND circuit 28 and to one input terminal, via an inverter 29, to an input of another AND circuit 30. The other input terminals of those AND circuits 28, 30 are connected to an output terminal Q of the second stage D type flip-flop 18B. The output terminal of the AND circuit 28 is connected to the data input terminal D of the first stage D type flip-flop 18A, and the output terminal of the AND circuit 30 is connected to the data input terminal D of the third stage D type flip-flop 18N.

Referring again to FIG. 2, 31 is the first flip-flop, which does not bias the reversible solenoid 3, when the output terminal Q of the flip-flop indicates "0" output signal (at this time feeding direction is forward), and biases the solenoid 3, when "1" output signal appears there. Numerals 32 and 33 are the second and third flip-flops, both output terminals Q of which are respectively connected to an OR circuit 34 on its input terminal. The output terminal of the OR circuit 34 is connected to the set side input terminal S of the first flip-flop 31, and the reset side input terminal R of the first flip-flop 31 is connected to the output terminal of an OR circuit 35, which is to be described hereinafter.

Numeral 36, in FIG. 2, is an initial set signal generating circuit for impressing "1" output signal, via an OR circuit 37, at the moment of power supplying, on the set side input terminal S of the first stage D type flip-flop 18A of the shift register 18, and on the reset side input terminal R of the D type flip-flops on and after the second stage, 18B, 18N, 18C, and 18D. The signal generating circuit 36 also supplies signals to the reset side input terminals R of the digital counter 13 and the flip-flops, from first to third, i.e., 31, 32, and 33, through which the output signals "1", "0", "0", and "0", come to each of the positive output terminals Q of the five stages of the shift register 18, from 18A to 18D.

An AND circuit 38, which receives an output signal from the output terminal Q of the first stage 18A of the shift register 18 and an output signal from the first rotary switch lever 14*b* as its input, is connected with its output terminal to the set side terminal S of the second flip-flop 32 and to the input terminal of an OR circuit 39. An AND circuit 40, which receives an output signal from the output terminal Q of the second stage 18B of the shift register 18 and the output signal from the second rotary switch lever 15*b* as its input, is connected, at the output terminal thereof, to the input terminal of the OR circuits 35 and 39, and the reset side input terminal R of the second flip-flop 32.

An AND circuit 41, which receives an output signal from the output terminal Q of the third stage 18N of the shift register 18, the heel side depress signal generator 10, and the finish side non-ravel seaming signal generator 42 (which is generated at every non-ravel seaming) as its input, is connected, at the output terminal thereof, to the set side input terminal S of the third flip-flop 33 and the input terminal of the OR circuit 39.

An AND circuit 43, which receives an output signal from the output terminal Q of the fourth stage 18C of the shift register 18 and an output signal from the third rotary switch lever 16*b* as its input, is connected, at the output terminal thereof, to the input terminal of the OR circuits 35 and 39, and to the reset side input terminal R of the third flip-flop 33 as well.

An AND circuit 44, which receives an output signal from the output terminal Q of the fifth stage 18D of the shift register 18 and an output signal from the fourth rotary switch lever 17*b* as its input, is connected, at the output terminal thereof, to the input terminal of the OR circuit 39 and to means, via a lead 45, for halting the needle at the preset position. Whenever an output signal of "1" comes to the lead 45 the needle is stopped instantly at its upper position and the thread is cut.

The output terminal of the OR circuit 39 is connected to the clock input terminal C of each stage, from 18A to 18D, of the shift register 18; every output signal "1" coming to the output terminal of the same 39 is supplied to the shift register 18 as a shift pulse for shifting the output signal of the shift register 18 step by step. The output signal from the OR circuit 39 is also impressed on an OR circuit 46, which is to reset the digital counter 13 whenever the "1" signal from the OR circuit 39 or from the toe side depress signal generator 9, or from the heel side depress signal generator 10 is supplied.

Numeral 47 designates a needle upper position stopping signal generator which is generated when the needle comes, after a series of seaming processes having been finished and the thread having been cut, to an upper position, for rendering all the circuits, each as digital counter 13, the shift register 18, etc., returned to the initial state when the power was supplied.

Numeral 48 designates a re-non-ravel seaming signal generator, which is for starting the machine to do a non-ravel seaming from a state, wherein the needle is stopped at a lower position, during the sewing operation, and ought not to do the non-ravel seaming because of the non-existence of the needle upper position stopping signal.

It means that the machine is caused to carry out the non-ravel seaming in a condition wherein it ought not to do that seaming operation; so the necessary signal can be sometimes given by the operator's switching operation.

OPERATION AND FUNCTION

Now a description is to be advanced which describes the function of the invention.

For better understanding the normal non-ravel seaming will be outlined referring to FIG. 4. The operator suitably sets first of all the forward and reverse sewing periods of the non-ravel seaming, A, B, C, and D, by means of adjusting the rotary switch levers, from first to fourth, i.e., 14*b*, 15*b*, 16*b*, and 17*b*, and closes at the same time the mode selecting switch 23. On one input terminal of the AND circuit 28 is therefore always impressed a "0" signal, so the output of that AND circuit 28 constantly indicates "0" state. Since one input terminal of the AND circuit 30 is, on the other hand, impressed with "1" input, whenever an output "1" appears at the output terminal Q of the second stage D type flip-flop 18B, an output "1" is generated at the AND circuit 30.

A power supply thereafter causes the digital counter 13, the flip-flops from the first to the third 31, 32, and 33 to be reset, and the output terminal Q of each stage of the shift register 18, i.e., 18A, 18B, 18N, 18C, and 18D to generate the output signals respectively "1", "0", "0", "0", and "0". If and when the foot pedal 6 is depressed at this state toward the toe side, a toe side depress signal generator 9 generates a signal to send a reset signal to the digital counter 13, and concurrently rotate the DC motor 4 at a medium speed suitable for non-ravel seaming by the control of the controlling means 11. Then the machine 2 begins to function and the material feeding means is, due to deenergization of the reversible solenoid 3, in the forward direction.

As the main shaft of the machine 2 rotates around, one pulse is generated from the pulse generator 12 for each 360° rotation, which is counted by the digital counter 13. The output signals from the digital counter 13 respectively appear on the output terminal, from $t_1$ to $t_{10}$, which are delivered to each of the stationary contacts, from $a_1$ to $a_{10}$, of the four readout switches, from 14 to 17. When the status of the output signal coincides with or meets the first rotary switch lever 14*b*, a signal "1" is generated there. As the output signal of the output terminal Q of the first stage 18A of the shift register 18 is in the "1" condition, an output signal "1" from the first rotary switch lever 14*b* will cause the AND circuit 38 to generate an output signal "1". Although output signals from the digital counter 13 will also come to the readout switches from the second to the fourth, 15, 16, and 17, no output signals are generated on each of the AND circuits 40, 43, 44, and 41, owing to the impression of "0" output signal, on one of input terminals thereof, coming from each output terminal Q of the shift register 18, from the second stage through the fifth stage 18B, 18N, 18C, and 18D.

The output signal "1" from that AND circuit 38 is then to be impressed on the set side input terminals S of the second flip-flop 32 for causing the same 32 to be set. The output signal "1" appearing on the output terminal Q of the same 32 will be, in turn, impressed on the set side input terminal S of the first flip-flop 31 via the OR circuit 34 for causing the same 31 to be set, which results in energization of the reversible solenoid 3 due to the input signal "1" appearing on the output terminal Q of the first flip-flop 31. It reverses the material feeding direction, which is shown in FIG. 4 as a conversion from A seaming to B seaming.

The output signal "1" of the AND circuit 38 is also impressed on the OR circuit 39, whose output signal "1" will cause the shift register 18 to shift its output signal step by step progressively or successively, and the digital counter 13 to be reset.

The seaming in a reverse directional feeding is thus proceeded and the number of stitches is to be counted just like in the forward feeding operation. At this state the shift register 18 has been shifted by one step to indicate the output signal "1" only at the output terminal Q of the second stage 18B; so if the status of the digital counter 13 meets the position of the second rotary switch lever **15*b* the AND circuit 40 generates an output signal "1", which causes the second flip-flop 32 to be reset and the first flip-flop 31 as well to be reset via the OR circuit 35, resulting in deenergization of the reversible solenoid 3 followed by the reversion of the feeding to forward direction. A shift of the output signal of the shift register 18 and a reset of the digital counter 13** take place at the same time.

By the above-mentioned way, the N portion seaming in FIG. 4 is carried out; but the logic product signal of the output terminal Q of the third stage 18N of the shift register 18 and the digital counter 13 is not taken up, allowing a desired amount of seaming in the forward feeding condition.

At this time, when the non-ravel seaming has been finished, the rotating speed of the DC motor 4 can be freely adjusted in accordance with the degree of the pedal depression. If the operator wishes to stop the machine 2 in the course of this seaming at a needle lower position, the needle can be so stopped owing to the function of the preset-position-needle-stop, only by releasing the toe depress of the pedal 6. If and when the operator wishes to carry out a non-ravel seaming in the sewing, starting from this needle lower position, it can be easily attained only by actuating a re-non-ravel seaming signal generator 48.

After a certain desired period of sewing operation, a heel depressing of the pedal 6 will cause generation of a heel depressing signal from the generator 10, a reset of the digital counter 13, and an impression of the output signal "1", owing to the heel depressing signal from the generator 10, on the AND circuit 41. As the "1" output signal from the output terminal Q of the third stage 18N of the shift register 18 and the "1" output signal from the finish-sewing-non-ravel-seaming signal from the generator 31 are both impressed on the AND circuit 41, an output signal "1" is naturally generated there. This output signal "1" is impressed on the third flip-flop 33 to set the same 33, and the first flip-flop 31 is therethrough set, followed by the energization of the reversible solenoid 3. A shift of the shift register 18 and a reset of the digital counter 13 are also simultaneously done via the OR circuit 39.

Sewing operation is herewith changed from the N stage to the C stage in FIG. 4, wherein the output signal of the fourth stage 18C of the shift register 18 is "1". In the same way as above-mentioned an output signal generated from the third rotary switch lever **16*b* causes generation of an output signal "1" from the AND circuit 43, which leads to a shifting of the output signal of the shift register 18, a reset of the digital counter 13, a reset of the third flip-flop 33, and a reset of the first flip-flop 31. As a result of which the reversible solenoid 3 will be deenergized, causing the sewing operation in FIG. 4 to change from the C stage to the D stage. During the sewing periods of C and D the DC motor 4** is set at a medium speed.

A "1" output signal from the output terminal Q of the fifth stage 18D of the shift register 18 and a "1" output signal from the fourth rotary switch lever **17*b* will make the output signal of the AND circuit 44 "1", causing a shift of the shift register 18 and a reset of the digital counter 13. A concurrently appeared output signal "1" on the lead 45 effectuates the function of the needle stopping at the preset position and ensures the needle stopping at the upper position after the thread cutting. Besides, the needle-up-position-stop signal 47, which is generated when the needle is stopped up, will keep all of the shift register 18, the stitch number counter 13**, etc., in the condition power supplied.

In the above embodiment sewing is started at the A and B initial non-ravel seaming in FIG. 4 and afterwards changed to a desired length of ordinary sewing N and finally re-changed to finish non-ravel seaming by means of shifting the shift register 18 by one step with the logical product composed of the "1" output signal of the third stage 18N of the shift register 18, "1" output signal from the heel depress signal generator 10 and "1" output signal from the finish non-ravel seaming signal generator 42. So the machine 2 is devised such that even if the pedal 6 should be heel-depressed in the course of initial non-ravel seaming, i.e., during A and B, it can not enter the finish non-ravel seaming; the initial non-ravel seaming can therefore be carried out with certainty.

Now the repeated non-ravel seaming or continuous non-ravel seaming will be described hereunder. In this instance the mode selecting switch 23 is opened, which results in apperance of a signal "1" at one input terminal of the AND circuit 28 and a signal "0" at the one input terminal of the AND circuit 30 via an inverter 29. Therefore, an output "1" which may come from the output terminal Q of the second stage 18B of the shift register 18 will make the AND circuit 28 generate an output "1", instead of making the AND circuit 30 generate an output "1", which is to be impressed on the first stage 18A of the shift register 18 as a data input.

If and when the operator starts sewing in this condition, in a similar way as the above-mentioned, every clock pulse from the OR circuit 39 will cause alternative appearance of "1" and "0" output signal at the output terminal Q of the first stage D type flip-flop 18A and at that of the second stage D type flip-flop 18B. In the meantime the third, fourth, and fifth stages, i.e., 18N, 18C, and 18D, remain in the condition of generating "0" output.

Repetition of the abovementioned non-ravel seaming A and B can be done in this mechanism. So long as the machine 2 is driven, with the mode selecting circuit 23 being open, the non-ravel seaming operation is repeated or circulated between A and B non-ravel seamings as long as desired. It is suited to be carried out in accordance with thickness of the material cloth or the like conditions of sewing operation.

For terminating the non-ravel seaming, all has to be done is a release of the toe depressing of the pedal 6. It goes without saying that the repeated non-ravel seaming can be continued only by a toe depressing again of the pedal 6.

After such a repeated non-ravel seaming and the desired ordinary sewing operation, a finish non-ravel seaming can be executed by means of opening the mode selecting switch 23 followed by the desired amount of repeated non-ravel seaming, and finally of closing the mode selecting switch 23. Otherwise similar machine operation as the above-mentioned will be applicable (refer to FIG. 5) to this case.

In the above embodiment a 2-bit shift register composed of two D type flip-flops, i.e., 18A and 18B for circulating the two kinds of output signals, is employed. It is only aimed at an alternative shifting of the output, so it is possible to substitute the same for a single flip-flop or the like, so long as the object is limited to a repeated non-ravel seaming. In this variant, a shift register containing five bits is also employed for successively changing the output signals. However, among them 18N can be substituted by any conventional means, so it can be omitted, so long as the rest of the four bits, from stages 18A, 18B, 18C and 18D are included. It means that the present invention necessitates having a shift register composed of at least four bits.

The other modifications are also possible without using all details of the system of the exemplary embodiment. For example, instead of a single counter connected to the four readout switches 14, 15, 16 and 17, four independent counters could be used; a preset counter could be used in case the non-ravel seaming is to have a fixed length.

The essential characteristics of the present invention can be summarized from the aforegoing as follows:

(1) Whenever seaming in one direction (forward or reverse) reaches a certain number of stitches preset on the digital counter, the machine is in a prepared condition for the reverse directional seaming;

(2) then the digital counter is reset;

(3) the output condition of the controlling circuits will be alternatively changed for enabling the signals to be repeatedly alternated, between forward and reverse, as many times as desired;

(4) it means a non-ravel seaming composed of forward and reverse feeding and can be repeatedly carried out as many times as desired;

(5) this repeated non-ravel seaming is suitably used for a thick material cloth or the like in preventing raveling or unseaming;

(6) this repeated non-ravel seaming is applicable not only to the initial or starting stage of sewing but also to the finish or terminating stage as well;

(7) the machine of this design can be used as a substitute for bar tacking; and (8) this invention is applicable for many types of sewing, and furthermore, able to meet still broader requirement by providing a free choice between an ordinary repeated nonravel seaming shown in FIG. 4 (initial non-ravel seaming and finish non-ravel seaming) and the afore-mentioned non-ravel seaming of free selectable length and number of repetition, by means of a mode selecting circuit which allows selective switching of the operation mode.

What is claimed is:

1. A control system for a sewing machine which includes a needle, work feeding means for feeding a work fabric and feed reversing means for reversing the feeding direction of the work feeding means, the reversing means including electrical means for controlling said reversing means, the control system comprising:

means for generating impulse signals in synchronism with vertical movement of said needle of said sewing machine during the operation of said sewing machine;

digital counting means for counting the impulse signals generated by said impulse generating means and generating a signal when the number of counted impulse signals corresponds with a predetermined respective impulse number for forward feeding and backward feeding;

electrical bistable means having a first output terminal and a second output terminal, each of said terminals being adapted to be alternately changed to the different stable-output state each time a stable-state-changing input signal is applied;

a first circuit connected with said electrical feed reversing means for actuating the same in response to the output signal of said digital counting means during generation of the output signal from said first output terminal of said bistable means;

a second circuit connected with said electrical feed reversing means for deactuating the same to effect the forward feed in response to the output signal of said digital counting means during generation of the output signal from said second output terminal of said bistable means;

a third circuit for providing said stable-state-changing input signal to said bistable means and providing a reset signal to said digital counting means in response to either one of output signals from said first circuit and said second circuit for making said first circuit and said second circuit alternatively and consecutively actuate and deactuate said electrical feed reversing means, boundlessly repeating; and terminating means for terminating the repetition of the actuation and deactuation, when a desired time has been reached, of said electrical feed reversing means by said first circuit and said second circuit.

2. A control system according to claim 1, in which said digital counting means comprises:

counter means for counting the impulse signals generated by said generating means and having a plurality of distinct states which occur sequentially, and readout means which is presettable in order to read out desired number on said counter means.

3. A control system for a sewing machine which includes a needle, work feeding means for feeding a work fabric and feed reversing means for reversing the feeding direction of the work feeding means, the reversing means including electrical means for controlling said reversing means, the control system comprising:

means for generating impulse signals in synchronism with vertical movement of said needle of said sewing machine during the operation of said sewing machine;

digital counting means for counting the impulse signals generated by said impulse generating means and generating a signal when the number of counted impulse signals corresponds with a predetermined respective impulse number for at least one of forward feeding and backward feeding;

electrical bistable means having a first output terminal and a second output terminal, each of said terminals being adapted to be alternately changed to the different stable-output state each time a stable-state-changing input signal is applied, said bistable means being a shift register having a capacity of two bits;

a first circuit connected with said electrical feed reversing means for actuating the same in response to the output signal of said digital counting means during generation of the output signal from said first output terminal of said bistable means;

a second circuit connected with said electrical feed reversing means for deactuating the same to effect the forward feed in response to the output signal of said digital counting means during generation of the output signal from said second output terminal of said bistable means, and a third circuit for providing said stable-state-changing input signal to said bistable means and providing a reset signal to said digital counting means in response to either one of output signals from said first and second circuit.

4. A control system according to claim 1, in which said bistable means is a flip-flop.

5. A control system for a sewing machine which includes a needle, work feeding means for feeding a work fabric and electrical feed reversing means for reversing the feeding direction of the work feeding means, the reversing means including electrical means for controlling the reversing means, the control system comprising:

means for generating impulse signals in synchronism with vertical movement of said needle of said sewing machine during the operation of said sewing machine;

digital counter means for counting the impulse signals generated by said impulse generating means and a plurality of distinct digital numbered states which appear sequentially;

a first readout switch connected with said digital counter means for selecting a numbered state of the same and providing an output signal, when the counting impulse signal number corresponds with a first predetermined impulse signal number;

a second readout switch connected with said digital counter means selecting a numbered state of the same and providing an output signal, when the counting impulse signal number corresponds with a second predetermined impulse signal number;

bistable means having a first and second output terminal, each of said terminals being adapted to be alternately changed to the different stable-output state each time a stable-state-changing input signal is applied;

a first circuit connected with said electrical feed reversing means for actuating the same in response to the output signal from said first readout switch during generation of the output signal from said first output terminal of said bistable means;

a second circuit connected with said electrical feed reversing means for deactuating the same to effect the forward feed in response to the output signal of said second readout switch during generation of the output signal from said second output terminal of said bistable means;

a third circuit for providing said stable-state-changing input signal to said bistable means and providing a reset signal to said digital counter means in response to either one of output signals from said first circuit and said second circuit for making said first circuit and said second circuit alternatively and consecutively actuate and deactuate said electrical feed reversing means, boundlessly repeating; and terminating means for terminating the repetition of the actuation and deactuation, when a desired time has been reached, of said electrical feed reversing means by said first circuit and said second circuit.

6. A control system according to claim 5, in which said digital counter means is a single digital counter.

7. A control system for a sewing machine which includes a needle, work feeding means for feeding a work fabric and electrical feed reversing means for reversing the feeding direction of the work feeding means, the reversing means including electrical means for controlling the reversing means, which is named the control system comprising:

means for generating impulse signals in synchronism with the vertical movement of the needle of said sewing machine during the operation of said sewing machine;

digital counter means for counting the impulse signals generated by said generating means and generating a signal when the counting impulse signal number corresponds with a predetermined respective impulse for forward and backward feeding signal number;

a shift register having a capacity of at least four bits and shifted each time a clock signal is applied;

a mode selecting circuit connected with said shift register for selecting a first operation mode in which the output signal is successively shifted from a first stage to a fourth stage or a second operation mode in which the output signal is circulated between said first and second stage;

a first circuit connected with said electrical feed reversing means for actuating the same in response to the output signal of said digital counter means during generation of the output signal from the first stage of said shift register after the starting of the sewing operation;

a second circuit connected with said electrical feed reversing means for deactuating the same to effect the forward feed in response to the output signal of said digital counter means during generation of the output signal from said second stage of said shift register after the reversing of the feeding direction;

a third circuit connected with said electrical feed reversing means for actuating the same in response to a non-ravel seaming command at the end of stitching;

a fourth circuit connected with said electrical feed reversing means for deactuating the same to effect the advancing feed in response to the output signal from said digital counter means during generation of the output signal from the third stage of said shift register after the reversing of the feeding direction;

a fifth circuit for finishing the non-ravel seaming operation in response to the output signal from said digital counter means during generation of the output signal from the fourth stage of said shift register after the forward of the feeding direction by said fourth circuit; and a sixth circuit for providing said clock signal to said shaft register in response to the output signal from said first, second, fourth and fifth circuit and providing a reset signal to said digital counter means in response to the output signal from said first to fifth circuit inclusive.

8. A control system for a sewing machine which includes a needle, work feeding means for feeding a work fabric and electrical feed reversing means for reversing the feeding direction of the work feeding means, the reversing means including an electrical means for controlling the reversing means, the control system comprising:

means for generating impulse signals in synchronism with the vertical movement of said needle of said sewing machine during the operation of said sewing machine;

digital counter means for counting the impulse signals generated by said impulse generating means and having a plurality of distinct states which appear sequentially;

a first to fourth readout switches inclusive connected with said digital counter means for selecting a state of the same and providing an output signal when the counting impulse signal number corresponds with a predetermined respective impulse for forward and backward feeding signal number;

a shift register having a capacity of at least four bits and shifted each time a clock signal is applied;

a mode selecting circuit connected with said shift register for selecting a first operation mode in which the output signal is successively shifted from a first stage to a fourth stage or a second operation mode in which the output signal is circulated between said first and second stage;

a first circuit connected with said electrical feed reversing means for actuating the same in response to the output signal from said first readout switch during generation of the output signal from said first stage of said shift register after the starting of the sewing operation;

a second circuit connected with said electrical feed reversing means for deactuating the same to effect the forward feed in response to the output signal from said second readout switch during generation of the output signal from said second stage of said shift register after reversing of the feeding direction;

a third circuit connected with said electrical feed reversing means for actuating the same in response to a non-ravel seaming command at the end of stitching;

a fourth circuit connected with said electrical feed reversing means for deactuating the same to effect the forward feed in response to the output signal from said third readout switch during generation of the output signal from the third stage of said shift register after the reversing of the feeding direction;

a fifth circuit for finishing the non-ravel seaming operation in response to the output signal from said fourth readout switch during generation of the output signal from the fourth stage of said shift register after the forward feed of the feeding direction by said fourth circuit; and a sixth circuit for providing said clock signal to said shift register in response to the output signal from said first, second, fourth and fifth circuit and providing a reset signal to said digital counter means in response to the output signal from said first to fifth circuit inclusive.

9. A control system according to claim 8, in which said digital counter means is:

a single digital counter, and said first to fourth readout switch inclusive is connected with said digital counter respectively.

10. A control system according to claim 8, in which said mode selecting circuit includes a mode selecting switch actuatable by an operator.

11. A control system according to claim 8, which further comprises four indicating means connected with each stage of said shift register for indicating the operative condition thereof.

12. A control system according to claim 11, in which said indicating means is a light emitting diode.

* * * * *